US008500614B2

(12) United States Patent
Rooks

(10) Patent No.: US 8,500,614 B2
(45) Date of Patent: Aug. 6, 2013

(54) PILATES REFORMER EXERCISE MACHINE

(76) Inventor: Michael Rooks, Washington, DC (US)

( * ) Notice: Subject to any disclaimer, the term of this patent is extended or adjusted under 35 U.S.C. 154(b) by 0 days.

(21) Appl. No.: 13/425,134

(22) Filed: Mar. 20, 2012

(65) Prior Publication Data

US 2012/0178602 A1 Jul. 12, 2012

Related U.S. Application Data

(62) Division of application No. 12/607,654, filed on Oct. 28, 2009, now Pat. No. 8,152,705.

(60) Provisional application No. 61/109,547, filed on Oct. 30, 2008.

(51) Int. Cl.

| | |
|---|---|
| ***A63B 26/00*** | (2006.01) |
| ***A63B 21/02*** | (2006.01) |
| ***A63B 21/04*** | (2006.01) |
| ***A63B 21/00*** | (2006.01) |

(52) U.S. Cl.
USPC ..... 482/142; 482/121; 482/130; 482/135

(58) Field of Classification Search
USPC ..... 482/34, 79, 142, 70–72, 92, 120–126, 482/131–140, 145–148, 907–908
See application file for complete search history.

(56) References Cited

U.S. PATENT DOCUMENTS

| | | | | |
|---|---|---|---|---|
| 4,340,214 | A * | 7/1982 | Schutzer | 482/51 |
| 5,951,027 | A * | 9/1999 | Oyen et al. | 280/11.225 |
| 6,042,523 | A * | 3/2000 | Graham | 482/121 |
| 6,607,472 | B2 * | 8/2003 | Toole | 482/123 |
| 6,971,976 | B2 * | 12/2005 | Endelman et al. | 482/121 |
| 7,288,053 | B2 * | 10/2007 | Endelman et al. | 482/142 |
| 7,465,261 | B2 * | 12/2008 | Barnard et al. | 482/142 |
| 7,645,218 | B2 * | 1/2010 | Potok | 482/141 |
| 7,803,095 | B1 * | 9/2010 | LaGree | 482/140 |
| 8,096,925 | B2 * | 1/2012 | Radding et al. | 482/54 |
| 2008/0248935 | A1 * | 10/2008 | Solow et al. | 482/142 |

* cited by examiner

*Primary Examiner* — Oren Ginsberg
*Assistant Examiner* — Joshua Lee

(57) ABSTRACT

A reformer includes a combined mount that serves to attach and support a foot bar assembly, a jump board, and a spring bar. The combined mount is easily and quickly attached to a side rail of a frame of the reformer. A carriage of the reformer includes a combined wheel axle and strap attachment point, which eliminates the need for a separate strap attachment bracket. The carriage also include side wheels which are mounted on the sides of the carriage, and which are biased outward so that they contact the side rails of the frame of the reformer.

11 Claims, 9 Drawing Sheets

FIGURE 2
BACKGROUND ART
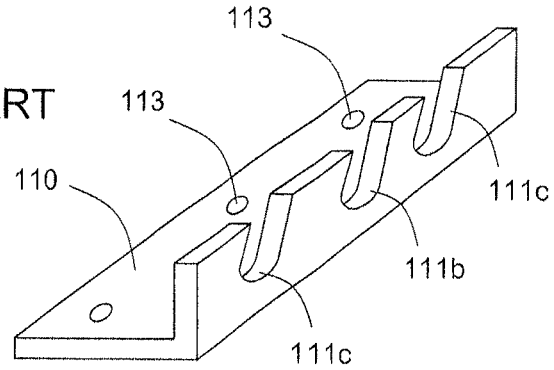
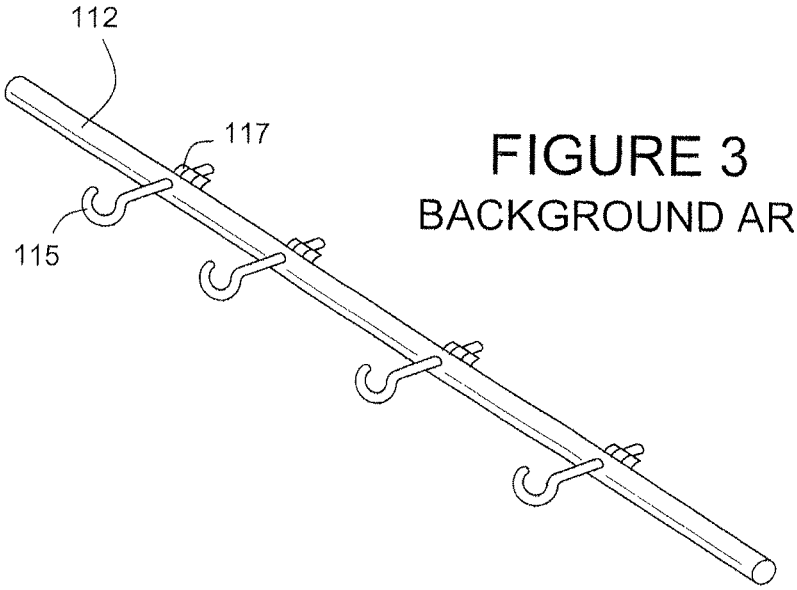
FIGURE 3
BACKGROUND ART
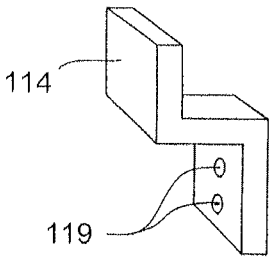
FIGURE 4
BACKGROUND ART

PILATES REFORMER EXERCISE MACHINE

This application is a divisional of U.S. patent application Ser. No. 12/607,654, filed Oct. 28, 2009, now U.S. Pat. No. 8,152,705 which itself claims priority to the filing date of U.S. Provisional Patent Application Ser. No. 61/109,547, filed on Oct. 30, 2008, the disclosures of both of which are hereby incorporated by reference herein.

BACKGROUND OF THE INVENTION

One common piece of exercise equipment used in Pilates studios is called a reformer. FIG. 1 shows portions of a typical background art reformer 100. The reformer includes a frame that includes side rails 102, end rails 104 and legs 106. The frame elements can be made of metal, wood, synthetic materials, and composites.

A carriage 140, like the one shown in FIG. 6, is slidably mounted on the frame. In most reformers, the carriage 140 includes wheels 142 that are rotatably mounted to the bottom of the carriage. The wheels 142 rest on channels 108 that are attached to the insides of the side rails 102 of the frame. This allows the carriage to be moved back and forth in the longitudinal direction along the frame.

The carriage has a "head" end and a "foot" end. The head end includes a head rest 150 and shoulder blocks 152. As is well known to those of skill in the art, springs, not shown, are attached between the bottom of the foot end of the carriage and a spring bar 112 that is mounted at the foot end of the frame. Because of the springs, the user must apply force to cause the carriage to move toward the head end of the frame. If the user releases this force, the springs pull the carriage back toward the foot end of the frame.

As shown in FIGS. 1 and 3, a typical spring bar 112 includes a plurality of spring hooks 115. The spring hooks 115 can include a threaded end that passes through the spring bar 112 such that a nut 117 can be used to couple the hook 115 to the spring bar 112. In many reformers, four springs can be attached between the bottom of the carriage 140 and the spring bar 112. The springs and the spring hooks 115 are configured such that it is easy to remove one or more springs from the spring hooks 115 on the spring bar 112. This allows the user to vary the amount of force required to move the carriage toward the head end of the frame. If all four springs are coupled to the hooks 115 on the spring bar 112, a large amount of force is required to move the carriage to the head end of the frame. If only one spring is coupled to a hook 115 on the spring bar 112, a much smaller amount of force is required to move the carriage toward the head end of the frame.

In addition, in most reformers, it is also possible to move the spring bar to different positions on the frame. This is commonly accomplished by spring bar mounts 110 which are attached to the side rails 102 of the frame. As shown in FIG. 2, a spring bar mount 110 can include a plurality of mounting holes 113. Screws or bolts pass through the mounting holes and into the side rail 102 of the frame to couple the spring bar mounts 110 to the side rails 102 of the frame. A plurality of mounting apertures 111*a*, 111*b*, 111*c* are formed in the spring bar mount 110. The ends of the spring bar 112 are mounted within one of the mounting apertures, as shown in FIG. 1.

Because multiple mounting apertures are formed along the length of the spring bar mount 110, the spring bar 112 can be positioned at multiple different locations on the frame. This also allows the user to adjust the amount of force that is required to move the carriage toward the head end of the frame, or at least the point at which the springs will begin to stretch as the carriage is moved toward the head end of the frame.

If the spring bar 112 is mounted in the rear-most mounting aperture 111*c*, the springs will begin to stretch when the carriage is located at a first position on the frame. If the spring bar 112 is moved to the front-most mounting aperture 111*a*, the springs will begin to stretch when the carriage is located at a second position on the frame, the second position being located closer to the head end of the frame than the first position.

In order to allow the user to easily remove one or all of the springs from the hooks 115 on the spring bar 112, the reformer is designed so that when the spring bar is located at the mounting position closest to the foot end of the frame, when the carriage is moved to the foot end, no tension is present in the springs. This allows the user to easily remove the springs from the hooks.

Because the reformer is dimensioned in this fashion, if the spring bar is located in the mounting position closest to the head end of the frame, when the carriage moves to the foot end of the frame, a great deal of slack is present in the springs. The springs typically sag downward under the force of gravity, which pulls the hooks 115 downward, which in turn causes the spring bar to rotate. In some instances, the spring bar 112 and hooks 115 rotate so much that the springs fall off the hooks.

Many reformers also include a foot or "jump" board 118 which is removably mounted on the foot end of the frame. A jump board mount 116 is attached to the inside of the end rail 104. The jump board mount 116 includes an aperture 116*a* which receives the jump board 118. When the jump board 118 is mounted on the frame in this manner, the user can lie on the carriage and push against the jump board 118 to move the carriage toward the head end of the frame. The springs would tend to resist this movement, and they would act to return the carriage to foot end of the frame.

Some of the activities practiced by the users require the user to sit or lay on the carriage and repeatedly push against the jump board with their feet. This imparts a torquing or rotational force to the jump board which is resisted by the jump board mount 116. Over time, after repeated or heavy use of the jump board, the jump board mount 116 can become loose, or physically separate from the foot rail 104 of the frame.

Many reformers also include a foot bar assembly, such as the one shown in FIG. 5. The foot bar assembly includes a U-shaped foot bar 120. Ends of the U-shaped foot bar 120 are rotatably mounted in foot bar brackets 126 which are attached to the inside of the side rails 102. This allows the foot bar 120 to rotate about the ends mounted in the foot bar brackets 126. The foot bar assembly also includes a U-shaped brace bar 128. Ends of the U-shaped brace bar 128 are rotatably coupled to the U-shaped foot bar 120. In addition, the middle section of the brace bar can be inserted into brace bar support brackets 114 mounted on the inside of the end rail 104 of the frame.

If the user wishes to use the foot bar assembly, the foot bar assembly is configured as shown in FIG. 5, with the foot bar 120 extending up above the frame, and with the middle section of the brace bar 128 inserted into the brace bar support brackets 114. In this configuration, if the user is lying on the carriage, the user can push against the foot bar 120 with their hands or feet to push the carriage toward the head end of the frame, against the force of the springs.

If the user does not wish to use the foot bar, the brace bar 128 can be removed from the brace bar support brackets 114, and the brace bar can be rotated upward with respect to the foot bar 120 so that the middle portions of the foot bar and the brace bar come together. The entire assembly can then be rotated downward so that the legs of the foot bar 120 and brace bar 128 come to rest on the end rail 104 of the frame. The middle portions of the foot bar 120 and the brace bar 128 would then extend out behind the end rail 104 of the frame. When the foot bar assembly is positioned in this folded configuration, it is possible to insert the jump board 118 into the jump board mount 116.

As is also well known to those of skill in the art, two straps are attached to the head end of the carriage, and the straps pass around rollers or pulleys mounted on the end rail of the frame located at the head end of the frame. The free ends of the straps are then attached to handles which can be grasped by the user. Thus, a user can pull on the straps to cause the carriage to move toward the head end of the frame against the force of the springs.

The ends of the straps are attached to the head end of the carriage 140 using two mounting bolts 146, as shown in FIGS. 6 and 7. Typically, the mounting bolts 146 are eye-bolts that are attached to a bracket 148 mounted on the underside of the head end of the carriage 140. As shown in FIG. 7, the bracket 148 could be L-shaped, and the leg of the L-shaped bracket 148 that extends downward from the underside of the carriage could include a hole that receives a threaded end of the eye-bolt 146. Thus, one or more nuts 145 could be used to attach the eye-bolt 146 to the bracket.

Most reformers have carriages 140 that include a layer of padding 154 attached to the upper side of the carriage. The padding could include a layer of a resilient material covered by an exterior layer of vinyl or other synthetic material. The outer covering layer would be designed to be washable. Likewise, the shoulder blocks 152 and the head rest 150 might also be covered by a padding layer with a vinyl or synthetic cover.

In known reformers, the padding and the synthetic covers are permanently attached to the carriage. As a result, if a user desires to replace the padding and cover layer, the carriage must be removed from the reformer, and the carriage must then be partially disassembled so that the synthetic cover and the padding can be removed and replaced.

BRIEF DESCRIPTION OF THE DRAWINGS

FIG. 2 is a perspective view of a spring bar mount of a background art reformer;

FIG. 3 is a perspective view of a spring bar of a background art reformer;

FIG. 4 is a perspective view of a brace bar support mount of a background art reformer;

DETAILED DESCRIPTION OF PREFERRED EMBODIMENTS

Figure 1:
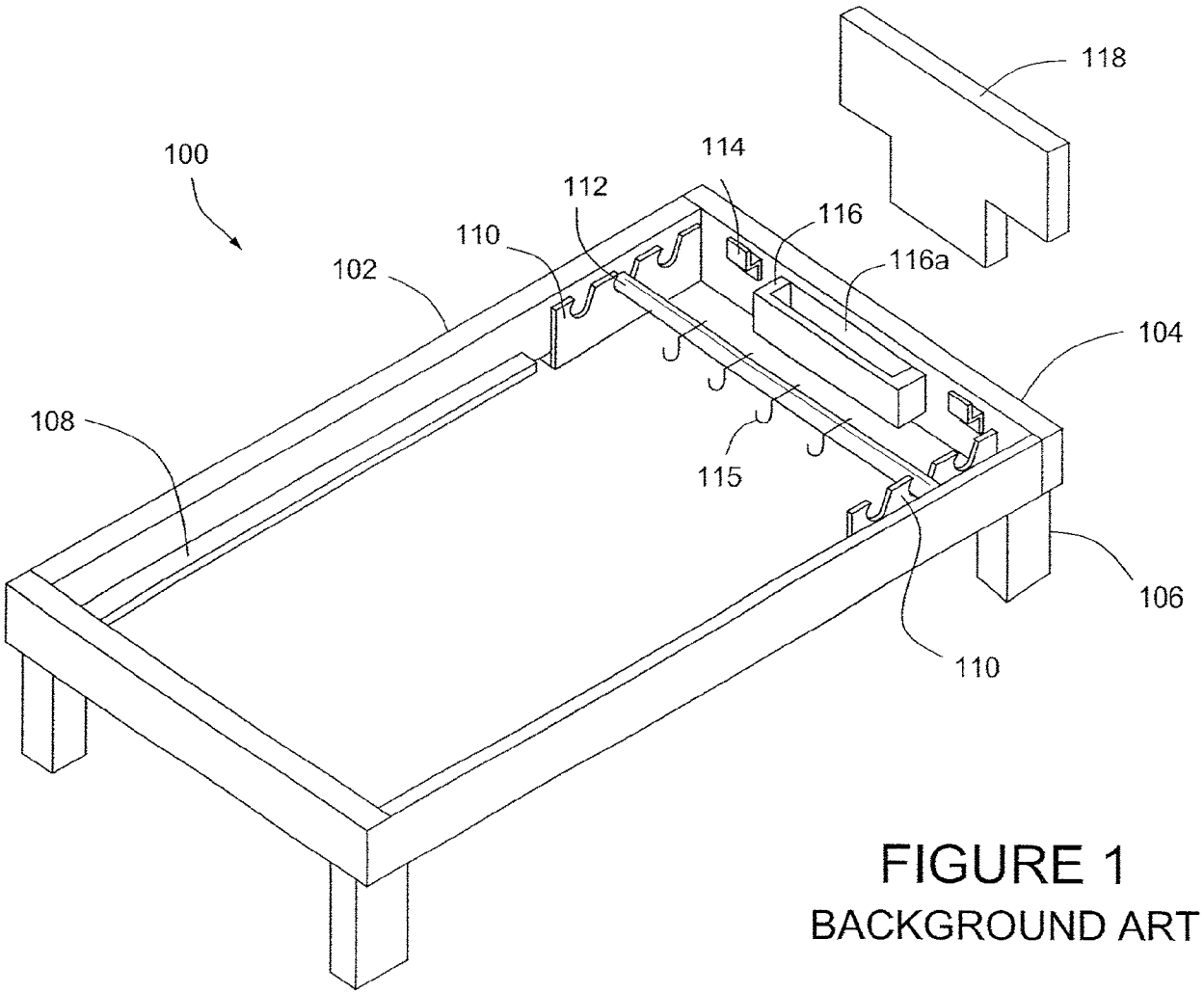
FIGURE 1 BACKGROUND ART
FIG. 1 is a perspective view of portions of a background art reformer.
Figure 5:
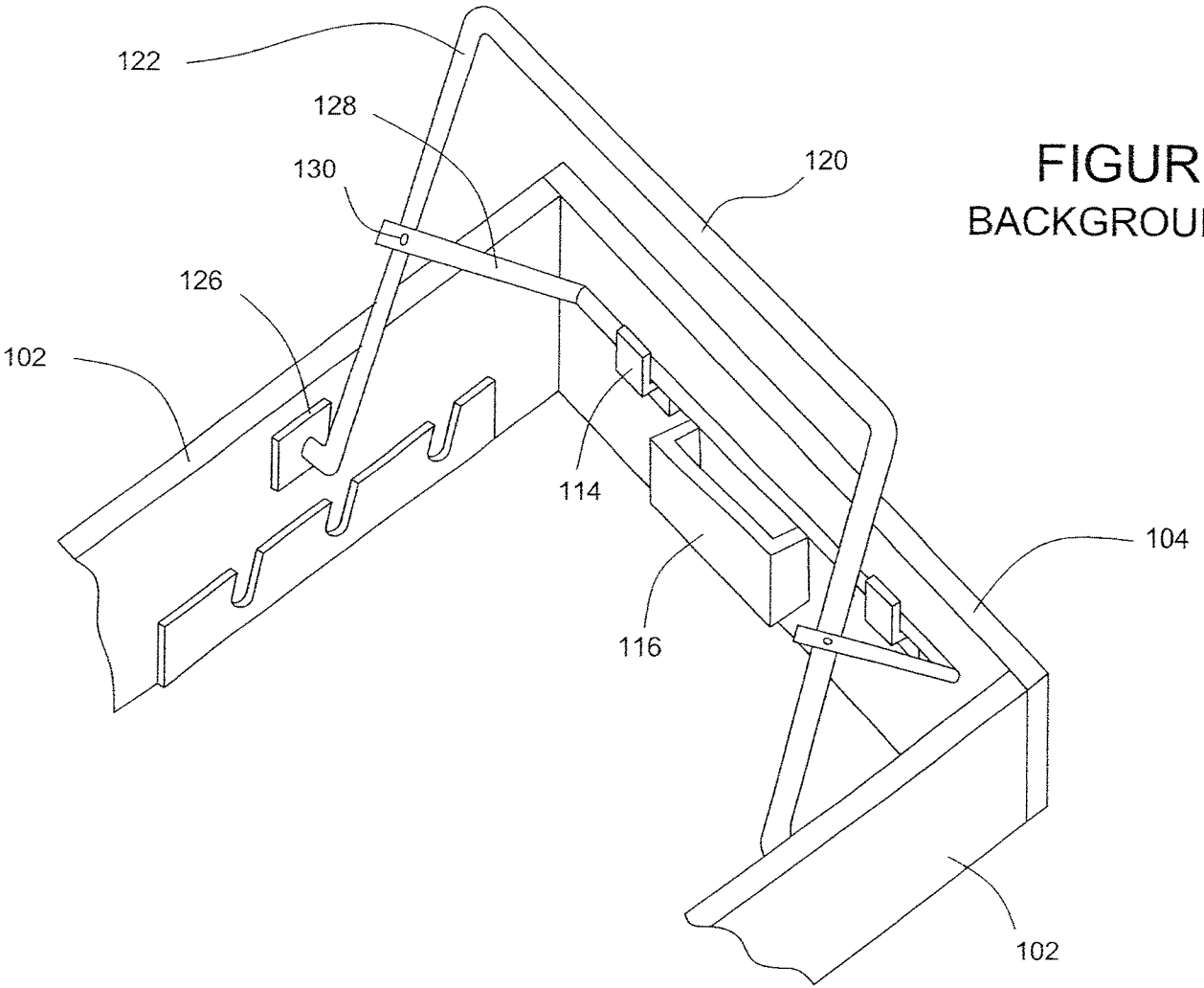
FIGURE 5 BACKGROUND ART
FIG. 5 is a perspective view of a foot end of a background art reformer showing a foot bar assembly.
Figure 6:
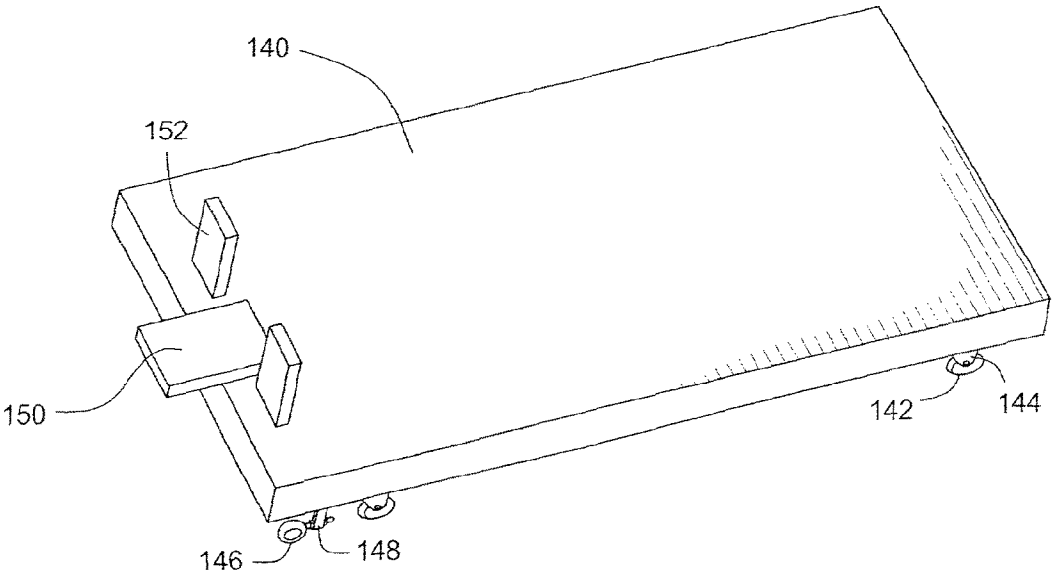
FIGURE 6 BACKGROUND ART
FIG. 6 is a perspective view of a carriage of a background art reformer.
Figure 7:
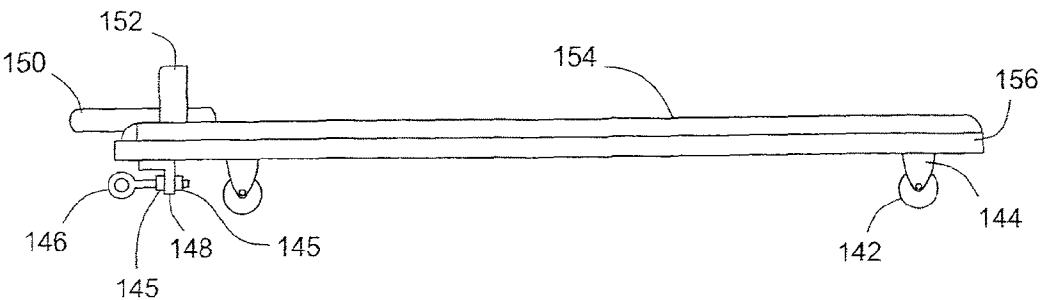
FIGURE 7 BACKGROUND ART
FIG. 7 is a side view of a carriage of a background art reformer.
Figure 8:
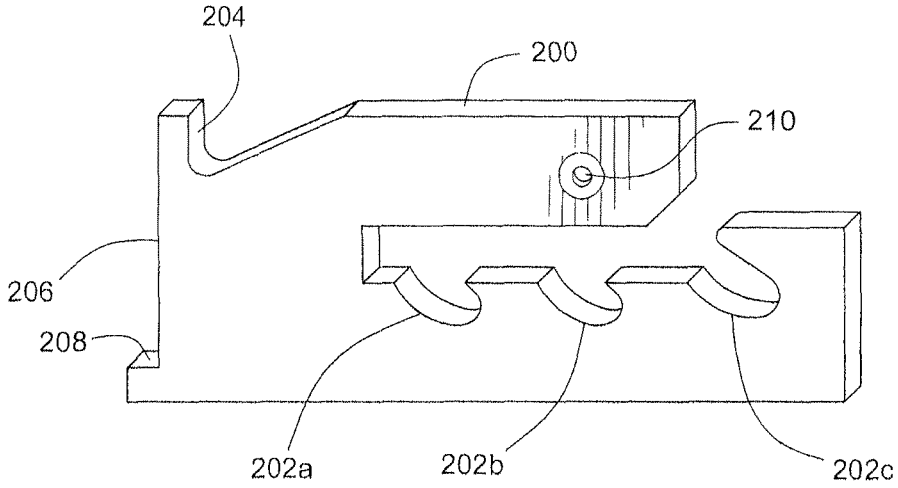
FIG. 8 is a perspective view of a first embodiment of a combined mounting bracket.
Figure 9:
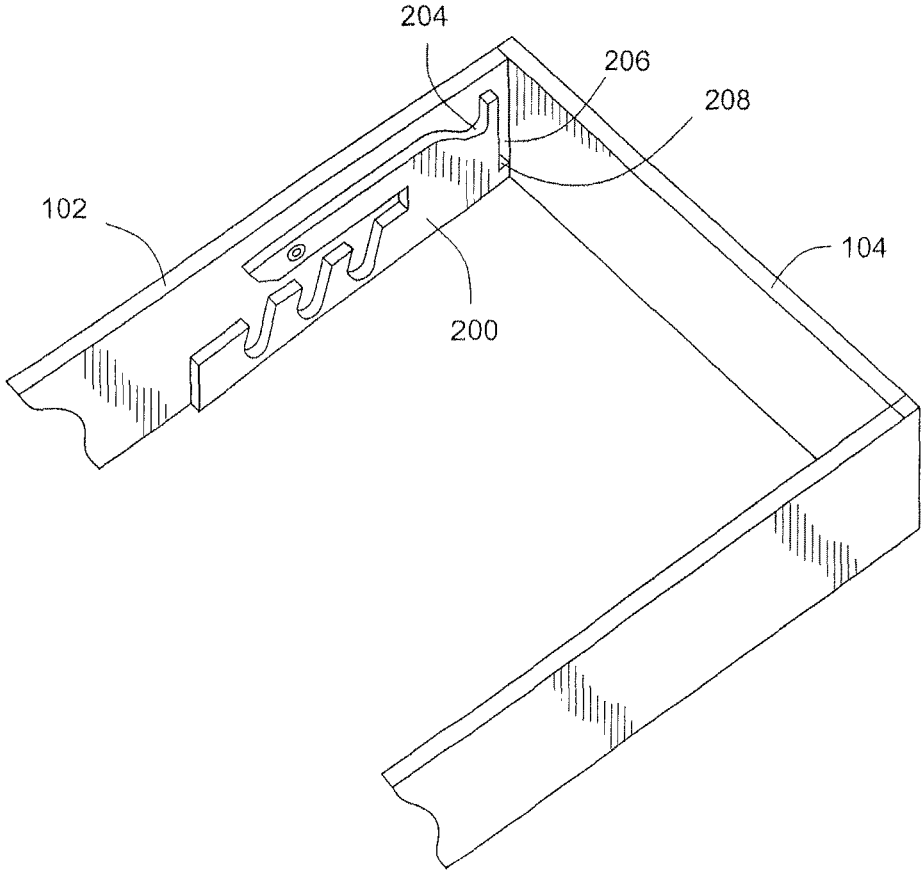
FIG. 9 is a perspective view of a foot end of a reformer showing how the combined mounting bracket shown in FIG. 8 could be attached to a frame of a reformer.

FIG. 8 shows a first embodiment of a combined mount 200 which can be used on a reformer. The combined mount accomplishes the functions of the spring bar mounts 110, the jump board mount 116, the brace bar support brackets 114 and the foot bar bracket 126 of the background art reformer shown in FIGS. 1-7. The combined mount 200 would be attached to the inside of the side rails 102 of a frame of a reformer as shown in FIG. 9.

The combined mount includes a plurality of spring bar mounting apertures 202*a*, 202*b*, 202*c* which can be used to position a spring bar at a corresponding plurality of mounting locations on the frame. Thus, the combined mount performs the function of the background art spring bar mount 110 shown in FIG. 2.

The combined mount also includes a foot bar mounting hole 210 to receive the ends 124 of a U-shaped foot bar 120. Thus, the combined mount performs the function of the foot bar brackets 126 of the background art reformer. In addition, in some embodiments, the foot bar mounting hole could include a ball bearing so that rotational movements of the foot bar 120 with respect to the frame are smooth and easy.

The combined mount includes a brace bar depression 204 which can receive the middle portion of a brace bar 128 of the foot bar assembly. Thus, the combined mount also performs the function of the brace bar support brackets 114 of the background art reformer.

The rear side of the combined mount has a rectangular cutout 206. The bottom of the rectangular cutout 206 would be defined by a rearward protruding portion 208, which would abut the inside of the end rail 104 of the frame, as shown in FIG. 9. The inside of the end rail 104, the top edge of the protruding portion 208, and the rear surface of the rectangular cutout 206 would define a slot that can receive a jump board of the reformer. Thus, mounting the combined mount as shown in FIG. 9 also eliminates the need for the jump board mount 116 of the background art reformer shown in FIGS. 1-7.

The combined mount could be made of metal, wood, synthetic materials, or composites. The combined mount could be attached to the side rail 102 of a reformer frame in multiple different ways. The combined mounts 200 could be attached with fasteners such as screws, bolts, rivets and the like. The combined mount could also be attached a side rail with an adhesive. In some embodiments, both fasteners and an adhesive could be used. In alternative embodiments, where both the combined mounts and the side rails of the frame are made of metal, welding could be used to attach the combined mount to the side rails.

Replacing the spring bar mounts, the brace bar support brackets, the jump board mount and the foot bar brackets with a single combined mount significantly reduces the number of different parts which must be fabricated to assemble a reformer, which reduces costs and the time required to assemble the reformer.

Also, in preferred embodiments, the combined mount would be designed so that the bottom edge of the combined mount can be aligned with the bottom edge of the side rail, and the rearward protruding portion could be butted against the end rail 104 to properly locate the combined mount on the reformer frame. This would provide an extremely simple and fast way to properly locate the combined mount during the assembly procedure. This is in direct contrast to the background art reformers where the spring bar mounts, the brace bar support brackets, the jump board mount and the foot bar brackets must all be separately positioned at the proper locations on the side and end rails of the frame before they are permanently mounted. In addition to reducing the assembly time, use of the combined mount would result in fewer assembly errors due to one or more of the separate elements in a background art reformer being improperly positioned during assembly.

Moreover, the fact that the jump board can be trapped between the end rail of the frame and the back of the combined mount should result in a more stable long term mounting of the jump board. The forces generated by a user pushing against the jump board can be transferred to the side rail of the frame over the large surface area of the combined mount that is in contact with the side rail of the frame. Thus, the combined mount is highly unlikely to become loose on the frame, even after repeated uses of the jump board.

A combined mount as described above could also be retrofitted to existing reformers that include all of the separate mounting elements described above.

Figure 10:
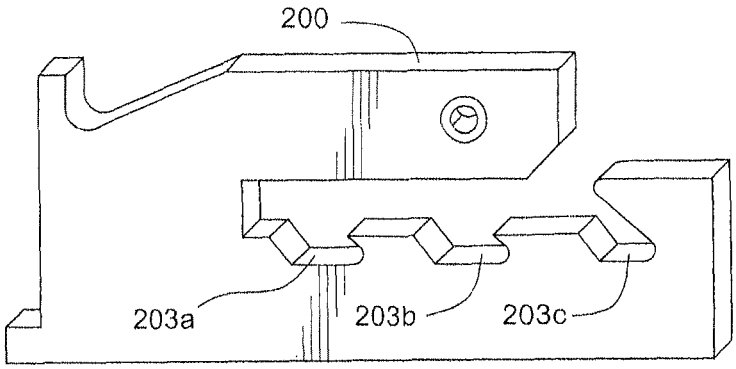
FIG. 10 is a perspective view of a second embodiment of a combined mounting bracket.
Figure 11:
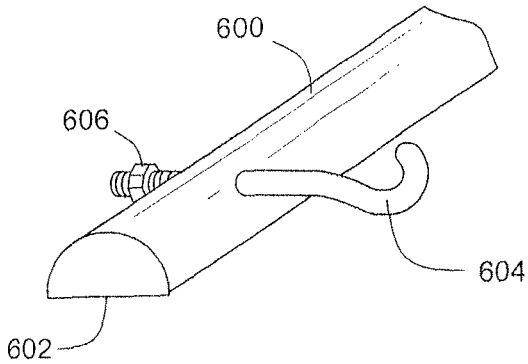
FIG. 11 is a perspective view of a first embodiment of a spring bar that could be used with the combined mounting bracket shown in FIG. 10.

An alternate embodiment of the combined mount is shown in FIG. 10. In this embodiment, the spring bar mounting apertures 203*a*, 203*b*, 203*c* have a flattened bottom. This embodiment would be designed for use with a spring bar having a flattened side, as shown in FIG. 11. Note, the normally round spring bar 600 has a flattened bottom 602 which is designed to rest against the flattened bottoms of the spring bar mounting apertures of the combined mount. When this arrangement is used, the spring bar will be far less likely to rotate when the springs sag downward, which should reduce or eliminate the problem of the springs falling off the hooks 604, as sometimes happens in the background art reformers described above.

Figure 12:
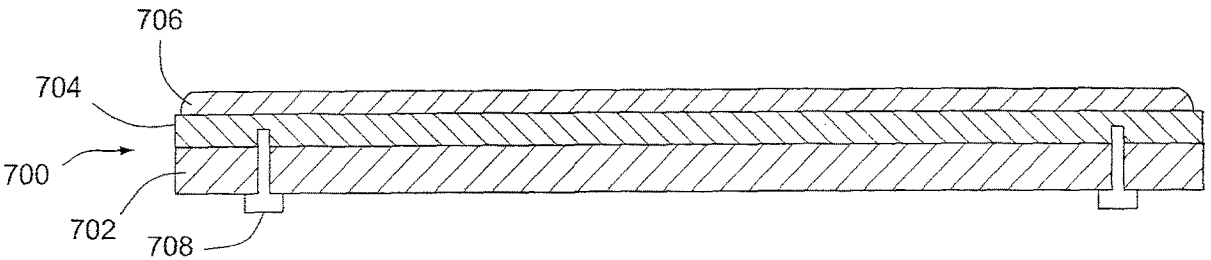
FIG. 12 is a sectional view of a portion of a first embodiment of a carriage of a reformer.

FIG. 12 shows a cross-sectional view of a first embodiment of a carriage of a reformer. As shown therein, the carriage 700 includes a base plate 702. An upholstery backing plate 704 is attached to the base plate 702 with a plurality of fasteners 708. A padding and cover layer 706 is attached to the upholstery backing plate 704. With a carriage as illustrated in FIG. 12, the padding and cover layer can be simply and easily replaced by removing the fasteners 708. This is in contrast to the carriage of a background art reformer described above, where the padding and cover layer are permanently attached to the carriage. Thus, with an arrangement as shown in FIG. 12, it is far more easy to replace the padding and cover of the reformer.

In preferred embodiments, both the padding and covers on the head rest and shoulder blocks would also be constructed as shown in FIG. 12. In other words, the padding and cover layers of the head rest and the shoulder blocks would also be attached to upholstery backing plates which are themselves attached to the main portions of the carriage. This would allow the cover and padding layers of the head rests and shoulder blocks to be easily replaced.

The padding and cover layer 706 of the carriage, and possibly of the head rest and shoulder blocks could include multiple layers of padding, and the different layers could have different thicknesses and different densities. The padding layers would then be covered with an external protective layer such a vinyl. The external protective layer would be made of a durable and washable material. The padding layers could me made of a synthetic material, such as an elastomeric foam or other similar materials.

Figure 13:
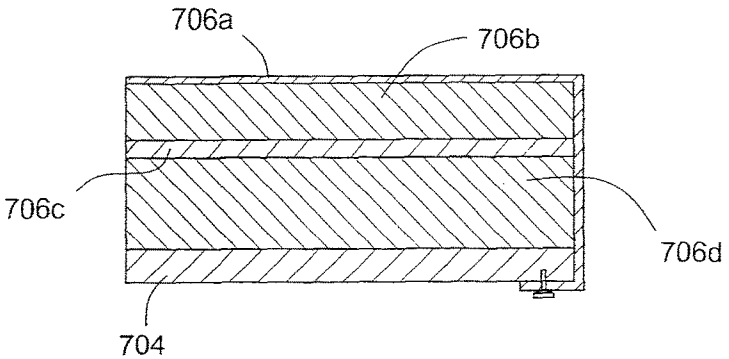
FIG. 13 is cross-sectional view of a portion of a side edge of a carriage of a reformer.

FIG. 13 illustrates a cross section of one side edge of an embodiment of the carriage. In this embodiment, three separate padding layers are mounted on the backing plate and covered with a vinyl protective layer. As shown therein, the padding layers include a relatively thick top layer 706*b* having a medium density. The middle layer 706*c* is a relatively thin layer having high density. The bottom padding layer 706*d* is a relatively thick layer of low density. As a result, the top layer 706*b* would have a medium flexibility or hardness, the middle layer 706*c* would be relatively hard, and the bottom layer 706*d* would be relatively soft.

The vinyl protective layer 706*a* covers the entire top surface, and also wraps around the side edges of the protective layers. The ends of the vinyl protective layer can be attached to the under side of the backing plate 704 with a plurality of fasteners 705.

Figure 14:
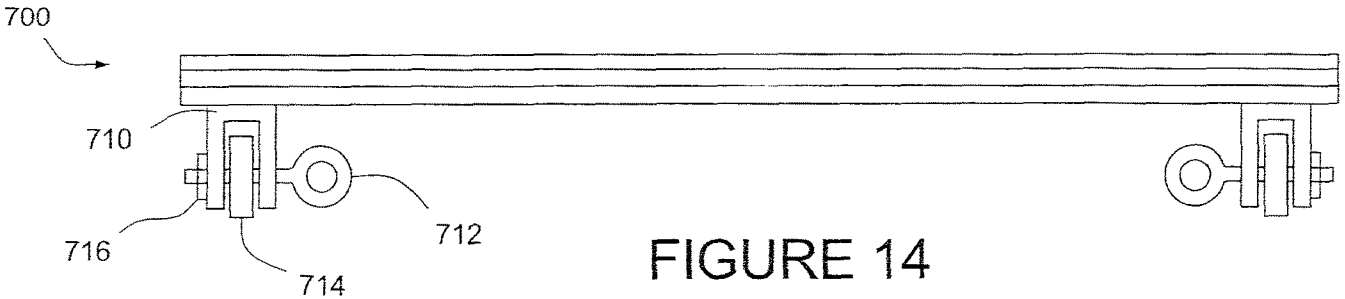
FIG. 14 is a front view of an embodiment of a carriage of a reformer.

FIG. 14 illustrates how the wheels on the bottom of the carriage are attached. As shown therein, mounting brackets 710 would be attacked to the bottom surface of the carriage 700. Wheels 714 would be rotationally mounted on the mounting brackets 710 with a combined axle and strap attachment point 712. The combined axle and strap attachment point 712 would serve as the axle of the wheel, and also the attachment point for a strap. This eliminates the need for the separate strap attachment bracket 148 of the background art carriage shown in FIG. 7. In preferred embodiments, the wheels would include ball bearing mounts, and the shaft of the combined axle and strap attachment point 712 would pass through the center of the ball bearing mount of the wheel 714.

Figure 15:
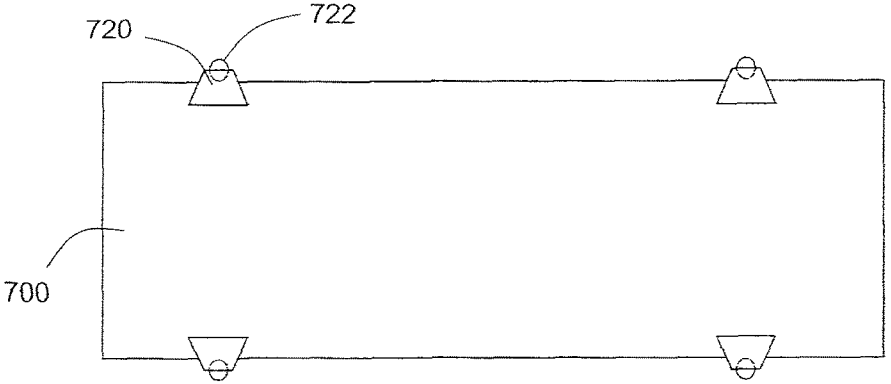
FIG. 15 is a bottom view of a carriage of a reformer illustrating side wheels.

Preferred embodiments of a carriage would also include side wheels, as shown in FIG. 15. In this embodiment, side wheels 722 are also mounted on the carriage 700 with side wheel mounts 720. When the carriage is mounted on the frame of the reformer, the side wheels would press against the inside surfaces of the side rails of the frame. This would help to ensure that the carriage is allowed to smoothly glide along the frame.

In preferred embodiments, the side wheel mounts 720 would include a biasing mechanism so that the side wheels can move inward and outward with respect to the side rails of the frame. The wheels would be biased outward so that they push against the side rails, and remain in contact with the side rails. This would help to prevent side to side movements of the carriage.

Figure 16:
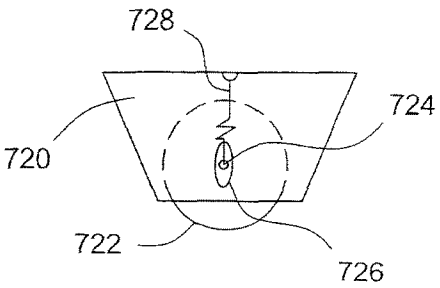
FIG. 16 shows an embodiment of a side wheel mounting bracket.

FIG. 16 shows one embodiment of a side wheel mount 720 which biases the side wheels outward towards the side rails of the frame. In this embodiment, and axle 724 of the side wheel 722 is mounted in an elongated slot 726. A spring or biasing element 728 would push the axle outward, providing the outward biasing force. In alternate embodiments of the side wheel mounting assembly, many other alternate configurations could be used to provide an outward biasing force for the side wheels. FIG. 15 only shows a single representative embodiment.

Figure 17:
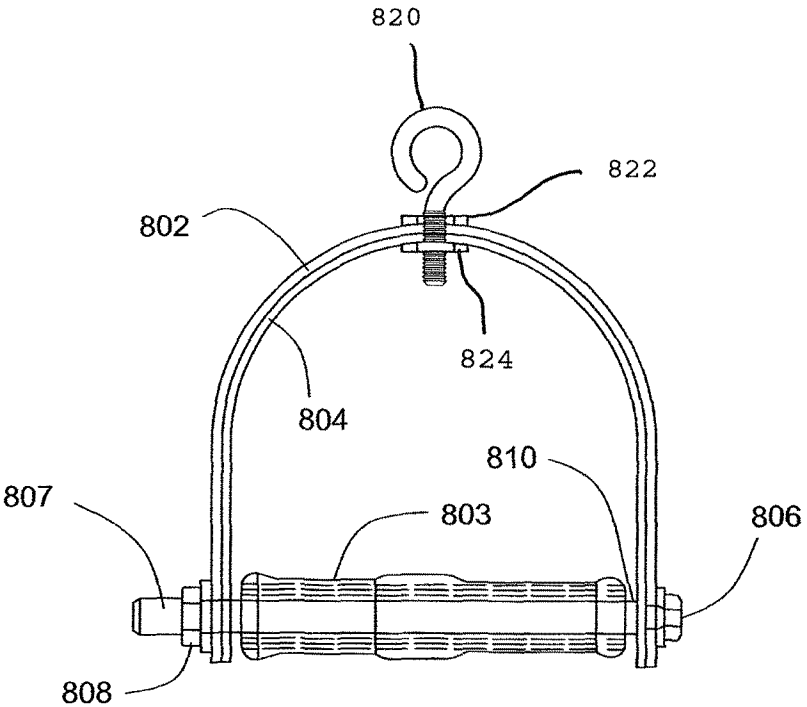
FIG. 17 is a diagram of a handle that would be attached to one of the straps of the reformer.

FIG. 17 shows a handle that would be attached to a strap of a reformer. The arched portion of the handle is formed from two layers 802, 804 of a firm but flexible material. In a preferred embodiment, the two layers 802 and 804 are both made of leather. However, in alternate embodiments, one or both of the two layers could be made from alternate materials which are able to maintain an arched shape, but which a flexible. The materials of the two layers should be made of a material that can contact a person's skin without hurting or irritating the skin. Also, in preferred embodiments, the two layers are not affixed to one another, except where the grip 803 and the attachment bolt 820 penetrate through the two layers. However, in alternate embodiments, a glue or other material might be used to join the two layers together throughout a part or all of the length of the layers.

The attachment bolt 820 penetrates through the two layers 802, 804 at the top of the arch. Two nuts 822, 824 are screwed onto a threaded shaft of the attachment bolt 820 from opposite sides of the two layers 802, 804 to attach the bolt to the top of the arched layers 802, 804.

Figure 18:
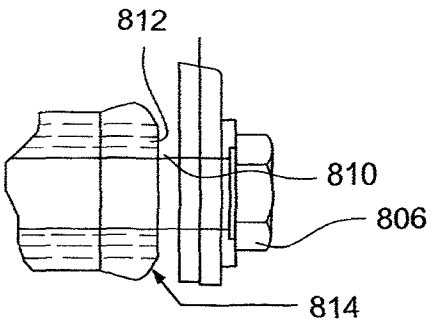
FIG. 18 is a close-up diagram of a portion of a handle showing the detailed structure of the handle.

The grip 803 is attached between the two ends of the arched layers 802, 804. Details of the grip construction are illustrated in FIG. 18. As shown therein, a fixation bolt 806 runs down the center of the grip. A nut 808 is screwed onto a threaded end 807 of the fixation bolt 806. A non-moving tube 810 surrounds the fixation bolt 806 and is sandwiched between the ends of the two arched layers 802, 804. A moving tube 812 surrounds the exterior of the non-moving tube 810. The interior diameter of the moving tube 812 is greater than the exterior diameter of the non-moving tube 810 so that the moving tube 812 can freely rotate around the non-moving tube 810. A flexible foam or synthetic material layer 814 is then affixed to an exterior of the moving tube 812.

While the invention has been described in connection with what is presently considered to be the most practical and preferred embodiments, it is to be understood that the invention is not to be limited to the disclosed embodiments, but on the contrary, is intended to cover various modifications and equivalent arrangements which are encompassed within the spirit and scope of the appended claims.

What is claimed is:

1. A carriage for a reformer, comprising:

a base plate;

a plurality of bottom wheel mounting brackets attached to a bottom surface of the base plate along two opposite sides of the base plate;

a plurality of bottom wheels, wherein at least one bottom wheel is mounted on each bottom wheel mounting bracket;

a plurality of side wheel mounting brackets attached to the base plate along the two opposite sides; and a plurality of side wheels, wherein at least one side wheel is mounted in each side wheel mounting bracket, wherein the side wheels are configured to contact inner sides of a reformer mounting frame upon which the carriage is mounted, and wherein each side wheel mounting bracket includes a biasing element that biases its at least one side wheel outward from the side of the base plate.

2. The carriage of claim 1, wherein each side wheel is mounted on an axle that is slidably mounted in a side wheel mounting bracket, and wherein each biasing element biases an axle of a side wheel outward away from a central portion of the base plate.

3. The carriage of claim 1, wherein each bottom wheel mounting bracket includes an axle that is used to mount a bottom wheel to the bottom wheel mounting bracket, and wherein an inner side of each axle includes an attachment point that is configured to be attached to a strap of a reformer that causes the carriage to move with respect to a frame of the reformer.

4. The carriage of claim 3, wherein each axle comprises an eye bolt, and wherein the eye end of each axle is oriented towards a central portion of the base plate.

5. The carriage of claim 1, further comprising:

an upholstery backing plate that is attached to the base plate with a plurality of fasteners; and an upholstery section attached to a top of the upholstery backing plate.

6. The carriage of claim 5, wherein the upholstery section comprises:

a plurality of padding layers mounted on a top of the upholstery backing plate; and a cover layer mounted on a top of the plurality of padding layers, wherein edges of the cover layer are fixed to the upholstery backing plate.

7. The carriage of claim 6, wherein the plurality of padding layers comprises:

a first padding layer mounted on top the upholstery backing plate;

a second padding layer mounted on top of the first padding layer, wherein the second padding layer is harder than the first padding layer; and a third padding layer mounted on top of the second padding layer, wherein the third padding layer is harder than the first padding layer, but softer than the second padding layer.

8. A carriage for a reformer, comprising:

a base plate;

a plurality of bottom wheel mounting brackets attached to a bottom surface of the base plate along two opposite sides of the base plate;

a plurality of bottom wheels, wherein at least one bottom wheel is mounted on each bottom wheel mounting bracket, wherein each bottom wheel mounting bracket includes an axle that is used to mount a bottom wheel to the bottom wheel mounting bracket, and wherein an inner side of each axle includes an attachment point that is configured to be attached to a strap of a reformer that causes the carriage to move with respect to a frame of the reformer;

a plurality of side wheel mounting brackets attached to the base plate along the two opposite sides; and a plurality of side wheels, wherein at least one side wheel is mounted in each side wheel mounting bracket, wherein the side wheels are configured to contact inner sides of a reformer mounting frame upon which the carriage is mounted, wherein each axle comprises an eye bolt, and wherein the eye end of each axle is oriented towards a central portion of the base plate.

9. The carriage of claim 8, further comprising:

an upholstery backing plate that is attached to the base plate with a plurality of fasteners; and an upholstery section attached to a top of the upholstery backing plate.

10. The carriage of claim 9, wherein the upholstery section comprises:

a plurality of padding layers mounted on a top of the upholstery backing plate; and a cover layer mounted on a top of the plurality of padding layers, wherein edges of the cover layer are fixed to the upholstery backing plate.

11. The carriage of claim 10, wherein the plurality of padding layers comprises:

a first padding layer mounted on top the upholstery backing plate;

a second padding layer mounted on top of the first padding layer, wherein the second padding layer is harder than the first padding layer; and a third padding layer mounted on top of the second padding layer, wherein the third padding layer is harder than the first padding layer, but softer than the second padding layer.

* * * * *